US006061850A

United States Patent [19]

Roper, III

[11] Patent Number: 6,061,850

[45] Date of Patent: May 16, 2000

[54] PORTABLE PLATFORM FOR BEACH UMBRELLA ADAPTED TO CARRY PILLOW AND OTHER OBJECTS

[76] Inventor: Jesse Roper, III, 11876 Gale Ave., Apt. B, Hawthorne, Calif. 90250

[21] Appl. No.: 09/112,710

[22] Filed: Jul. 9, 1998

[51] Int. Cl.[7] ..... A47G 9/06

[52] U.S. Cl. ..... 5/418; 5/417; 5/414; 248/519; 248/539

[58] Field of Search ..... 5/418, 121, 128, 5/417, 414; 135/76, 120.3, 114; 248/519, 534, 539, 535, 415, 418

[56] References Cited

U.S. PATENT DOCUMENTS 351,669 10/1886 Tosso ..... 248/535 X
4,100,633 7/1978 Pintos ..... 5/418
5,076,405 12/1991 Modica ..... 5/417 X
5,347,667 9/1994 Schwarz et al. ..... 5/418
5,427,346 6/1995 Urgola ..... 248/519

*Primary Examiner*—Terry Lee Melius
*Assistant Examiner*—Rodrigo J. Morales
*Attorney, Agent, or Firm*—A. M. Fernandez

[57] ABSTRACT

A portable platform for carrying to the beach a beach umbrella, umbrella support pole and pillow, all VELCRO fastened to the platform which serves to keep the pillow off the sand and to provide a cup holder and/or a box to secure small items, such as car keys and money, that may otherwise be lost in the sand. The platform may also be used to carry a stereo entertainment system onto the beach and to keep it out of the sand while the platform is placed on the beach to hold upright the umbrella support pole upon which the umbrella is fastened.

6 Claims, 3 Drawing Sheets

11
15a
15c
15e
15d
17
13
15e
13
15d
15b
15b
18
15a

10'
12
15c
16a
16
16a
16
11

17
15c
18
13
15d
15a
15e
15b
10'
12

PORTABLE PLATFORM FOR BEACH UMBRELLA ADAPTED TO CARRY PILLOW AND OTHER OBJECTS

FIELD OF THE INVENTION

The invention relates to means for carrying an umbrella and a pillow to the beach together with other objects that need to be protected from sand on the beach.

BACKGROUND OF THE INVENTION

Sandy beaches are rarely accessible by motor vehicle, and it is often necessary to walk a long distance to the water's edge over very loose sand and of course the farthest from where the car is parked is the most desirable part of the beach, namely at or near the high-water mark reached by the breaking surf. The dry sand beyond the high-water mark is often very fine and loose to a considerable depth so that it is easy to lose small objects in the sand, and objects as large as car keys. Even larger objects, such as portable radios or audio tape and disk players that are too big to lose in the sand can become embedded in sand to a point where damage is caused by loose sand if placed directly on the beach. Consequently, it is the practice of many beach goers to carry several objects in a beach bag and at a minimum an umbrella for shade of at least the face, a towel, a pillow for comfort, and a radio, audio tape or laser disk player for entertainment besides personal items, such as lipstick and a comb. All that is much too cumbersome and awkward to carry.

Then there is a fear of losing personal items in the sand and having the entertainment system damaged by loose sand. The dry sand may be loose to such a considerable depth that it becomes difficult to keep the entertainment system from sinking in the sand and to keep an umbrella supported on an upright pole from being tipped over by gusts of wind, or to keep an umbrella tilted at a proper angle to cast shade on the other side of the support pole without it being swivelled on its pole by gusts of wind such that the umbrella will no longer be casting its shade in the desired direction. It is very annoying to have to continually adjust the umbrella under those conditions. Sun bathers typically want to lie with their heads under the umbrella out of the sand and supported by a pillow.

STATEMENT OF THE INVENTION

An object of this invention is to provide a platform made of a sheet of lightweight, rigid and durable material, such as wood or plastic, with a hand grip near one edge for carrying the platform and with means affixed to the platform for holding one end of an umbrella support pole perpendicular to the platform after it is placed horizontally on the sand and further having means for securing the umbrella, support pole and pillow on the platform for conveniently carrying them to the beach.

In one embodiment of the invention, means affixed to the platform for holding one end of the umbrella support pole upright is at one location some distance from all sides of the platform to prevent small gusts of wind from catching the opened umbrella and tipping the platform, even without any significant weight on the platform. A short rod at the end of the support pole at the end opposite the one end is oriented 90° from the axis of the support pole. Means for clamping the handle of the opened umbrella on this horizontal short rod is provided in order to orient the handle of the umbrella at any desired angle up to about 90° in either direction around the axis of the short rod so that the umbrella shadow will be cast to either side of the platform while the support pole may be turned on its axis to place the short rod in a selected one of a plurality of radial positions. A suitable means is provided for locking the support pole at a selected one of a plurality of radial positions of the short rod, thus setting the direction in which the shadow of the opened umbrella is cast relative to the platform.

The platform on one side of the support pole accommodates a pillow strapped to the platform for carrying. A space is also provided on the platform on the side opposite the pillow for strapping the unopened umbrella and its support pole to the platform for carrying. Between the pillow and the space for strapping the unopened umbrella, there is provided on the platform means for securing at least one of a selected number of items such as a radio, tape or laser cassette with stereo speakers and/or a box for storing small objects out of sight, such as car keys and money, for example.

In another embodiment of the invention, the means affixed to the platform for holding one end of the umbrella support pole is duplicated at a plurality of positions, each adjacent an edge of said platform at different sides to hold the support pole of the umbrella at any selected one of the plurality of positions on the platform, and preferably three positions, two positions near opposite sides of the platform and a third at a position on the platform that defines a triangle with respect to the positions of the other two at sides. While the platform may more easily tip in the direction of one of the opposite sides at which the umbrella support pole is placed, any object of significant weight, such as a stereo radio, tape or laser disk entertainment system, will prevent small gusts of wind from tipping the umbrella and platform, but with a sunbathing person's head on the platform with or without the pillow, tipping will not likely occur. An advantage of this embodiment is that it provides more free space for a large box for storing objects or a large stereo entertainment system, or both, with the entertainment system strapped over the large box for carrying and the box built into the platform.

In all embodiments, the pillow may have a beach towel attached to it such that opposite sides thereof may be folded in and the folded towel then furled around the pillow before strapping it on the platform while carrying it to the beach. On the beach, the towel is unfurled from the pillow which may be restrapped on to the platform so that the beach goer may use the towel to recline on the beach with his/her head on the pillow that is supported off the sand by the platform. These and other variations are intended to be within the scope of the invention.

The novel features that are considered characteristic of this invention are set forth with particularity in the appended claims. The invention will best be understood from the following description when read in connection with the accompanying drawings.

DETAILED DESCRIPTION OF THE INVENTION

Figures 1, 2, 3:
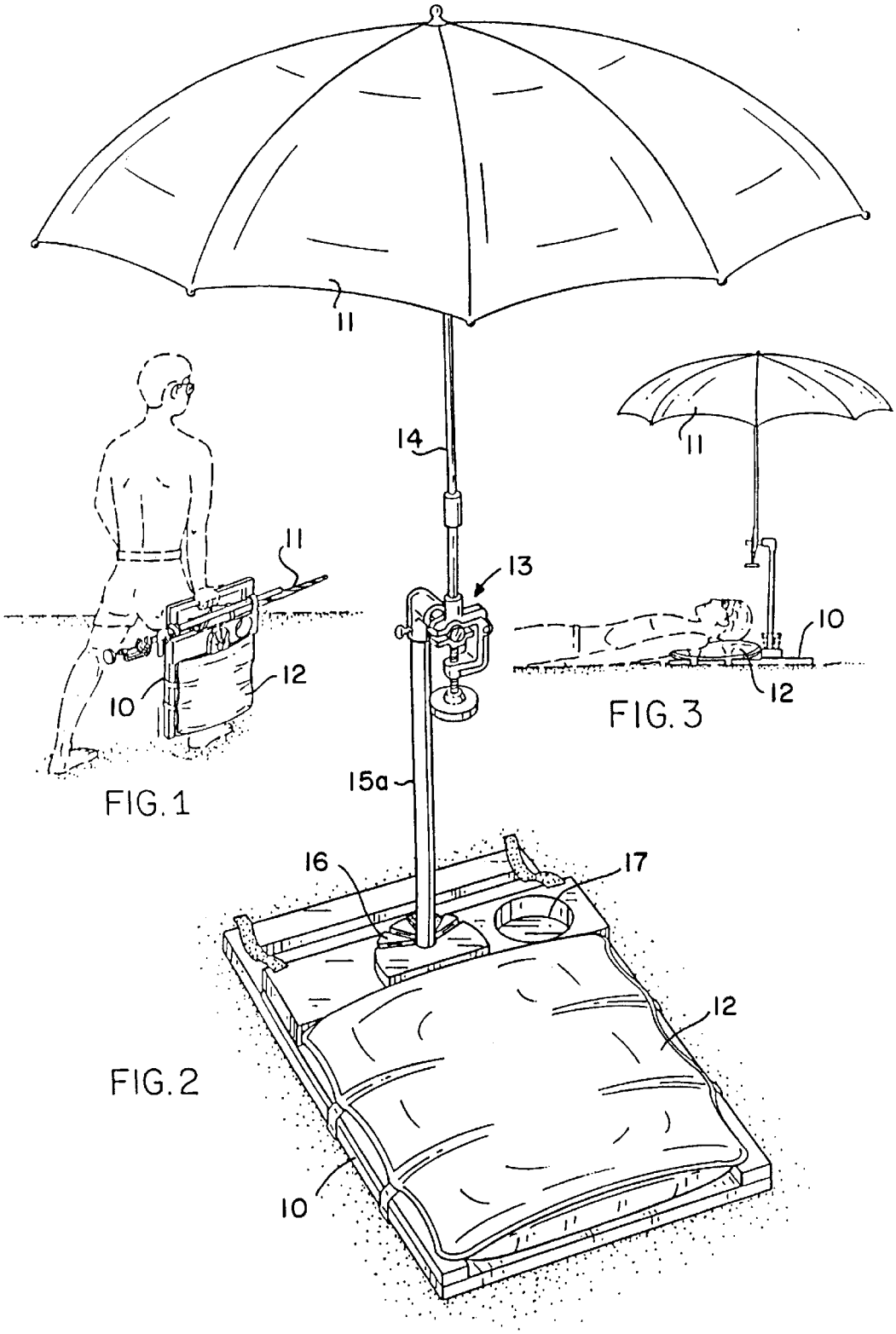
FIG. 1 illustrates a portable platform 10 for a beach umbrella 11 and pillow 12 being carried to the beach.
FIG. 2 illustrates the platform 10 set up with the umbrella 11 open.
FIG. 3 illustrates the platform 10 and pillow 12 being used by a beachgoer with the pillow 12 being supported by the platform 10 under the open umbrella 11.

Referring to FIGS. 1, 2 and 3, a platform 10 is provided for carrying to the beach an umbrella 11 and a pillow 12 strapped to a platform. Upon arriving at the beach, the beachgoer lays the platform 10 on the sand and unstraps the umbrella which has a clamp 13 on the end of the umbrella handle 14. An umbrella support pole 15*a*, also unstrapped with the umbrella, is inserted into a hole in a means 16 affixed to the platform for holding one end of the support pole 15*a* perpendicular to the platform. Then the clamping means 13 is used to fasten the umbrella to a short rod 15*b* extending from the end of the support pole 15*a* at 90° to the axis of the support pole 15*a* so that the clamping means 13 may be used to set the umbrella tilted about the axis of the short rod 15*b* before or after it is opened.

Figures 4, 5, 6:
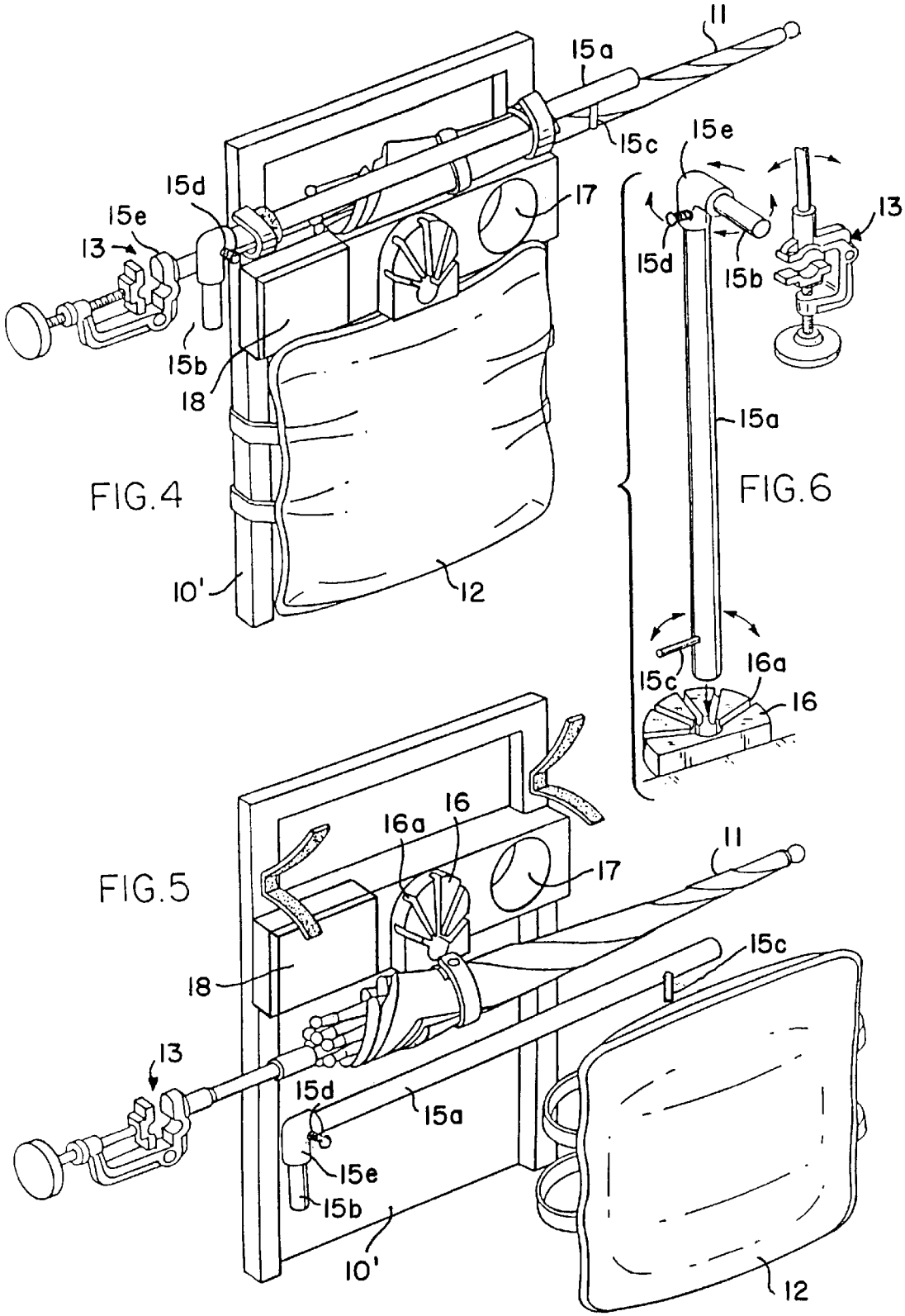
FIG. 4 illustrates to a second embodiment of a portable platform 10' with the beach umbrella 11 and pillow 12.
FIG. 5 illustrates the portable platform 10' to the same scale as in FIG. 4 with umbrella 11 and pillow 12 shown unstrapped in order to more clearly illustrate the umbrella 11 with means 13 for clamping the umbrella handle 14 to a support pole 15*a* on a short rod 15*b* extending out at 90° with respect to the axis of the support pole 15*a*.
FIG. 6 illustrates in an exploded view the manner in which the support pole 15*a* is inserted in a means 16 for holding the support pole 15*a* perpendicular to the platform 10 with the short rod 15*b* turned to any one of a number of angular positions while the clamping means 13 is used to tilt the umbrella to one side or the other of the support pole 15*a*.

FIG. 4 illustrates a second embodiment of a platform 10' and FIG. 5 shows the umbrella 11 and pillow 12, which are the same as in FIGS. 1, 2 and 3, removed from the platform 10'. The main difference is that in addition to a cup holder 17 a box 18 is built into the platform.

Referring to FIG. 6, a peg 15*c* extends perpendicularly to the axis of the support pole 15*a* at the end inserted into the hole in the means 16. That peg will fit into one of a plurality of slots 16*a* on the surface of means 16 in order to select the direction of the short rod 15*b* relative to the platform. To further adjust the direction selected, or to make any general adjustment of direction without limitation, a set screw 15*d* is loosened in order to turn a 90° elbow 15*e* that secures the short rod 15*b* to the top of the support pole 15*a*. After adjustment, the set screw 15*d* is tightened.

In that manner, the platform and umbrella are set up in the same manner as shown in FIG. 2, and the umbrella is tilted to one side or the other with the clamping means 13 and turning the support pole 15*a* on its axis to cast the shade of the umbrella in a selected direction using the peg 15*c* and a selected slot 16*a* described with reference to FIG. 6 or instead using the elbow 15*e* to swivel the short rod 15*b* for selecting any desired direction for casting the shade of the umbrella. A cup holder 17 and a box 18 are provided on the platform for the convenience of the beachgoer, either of which may be used to hold car keys and money, but the box provides greater security. The cup holder then is merely for the convenience of holding a cup or a soft drink bottle.

In all embodiments the preferred means for strapping the umbrella and support pole onto the platform is VELCRO fastening means. The pillow is also best fastened with VELCRO fastening means, although for the pillow elastic straps could be used, but since elastic straps tend to loose elasticity with exposure to sun and moisture, it is preferred to use VELCRO fastening means.

Figure 7:
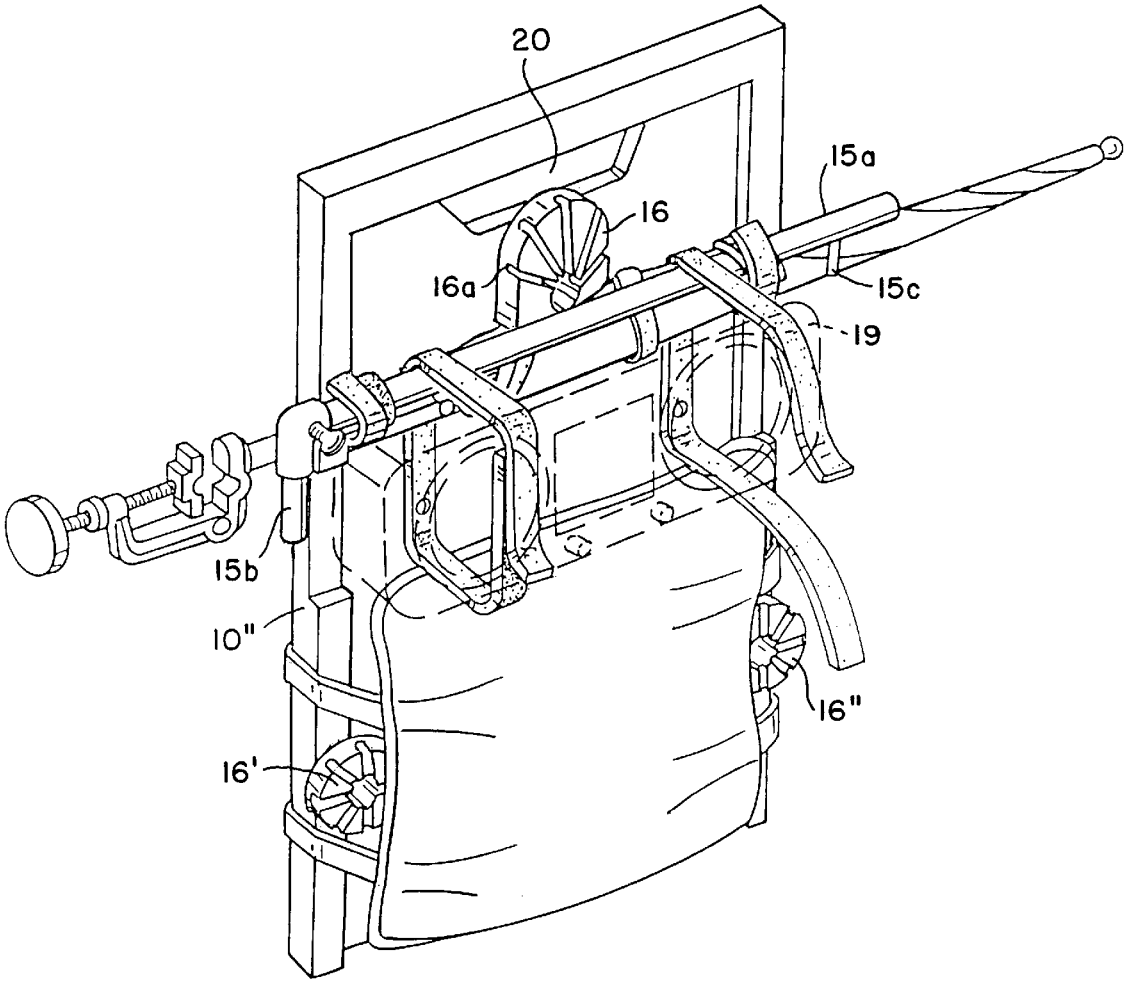
FIG. 7 illustrates a third embodiment of a portable platform 10" for a beach umbrella having three means (16, 16' and 16") for holding the support pole 15*a* at three different positions on the platform in order to accommodate a large stereo system 19, or a large box for storing small items.

Referring now to FIG. 7, which illustrates a third embodiment intended to carry a stereo radio, tape or disk entertainment system 19, the means 16 with slots 16*a* provided for holding one end of the support pole 15*a* perpendicular to the platform 10' is placed closer to the upper end of the platform to provide space for strapping the stereo entertainment system, and two other such means 16' and 16" are provided, thus allowing selection of three points arranged in a triangle on the platform for positioning the umbrella relative to the platform. Because of a greater weight of the package to be carried, a hand hole 20 provides the beachgoer with a better grip. A similar hand hole could be provided in the first embodiment instead of having the beachgoer simply use a frame around three sides of the platform as the hand grip.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. A portable beach platform for carrying a beach umbrella, the beach umbrella, a support pole for said umbrella, said support pole having a short rod attached to one end thereof by a 90° elbow, and a pillow comprising a platform of lightweight, rigid and durable material with a handgrip near one edge for carrying, means for strapping said umbrella onto said platform together with said umbrella support pole, means for strapping said pillow onto said platform, means affixed to said platform for holding the other end of said umbrella support pole opposite said one end with its axis perpendicular to said platform after said platform is placed horizontally and said umbrella support pole is unstrapped together with said umbrella, and clamping means connected to a handle of said umbrella for fastening said umbrella handle to said short rod of said support pole at said one end in a desired axial position with respect to said axis of said support pole.

2. A portable beach platform as defined in claim 1 wherein said 90° elbow is set on said support pole and is rigidly attached to said short rod, and said clamping means includes means for tightening said clamping means to grip said short rod of said support pole after setting the axial position of said umbrella with respect to said axis of said support pole.

3. A portable beach platform as defined in claim 2 wherein said elbow set on said support pole is set tight by a set screw that may be loosened to select a radial position of said short rod of said support pole with respect to said platform after which said set screw is tightened.

4. A portable beach platform as defined in claim 2 wherein said means affixed to said platform for holding said second end of said umbrella support pole comprises a plate with a hole and radial notches for receiving said one end of said umbrella support pole, and said one end of said support pole includes a radial peg that fits into any selected one of said radial notches, whereby setting said peg into a notch selects the radial position of said short rods of said support pole.

5. A portable beach platform as defined in claim 1 including a cup holder in said platform.

6. A portable beach platform as defined in claim 1 including a box for storing small items while said platform is in use.

* * * * *